US006276274B1

(12) United States Patent
Hoffman, Jr. et al.

(10) Patent No.: US 6,276,274 B1
(45) Date of Patent: Aug. 21, 2001

(54) PLATEN FOR A PRINTING MACHINE

(75) Inventors: Richard C. Hoffman, Jr., Lake Forest; Alex Iaccino, Mount Prospect; Dariusz Tkacz, Naperville; Boguslaw Biel, Carol Stream; Boguslaw Magda, Wheaton, all of IL (US)

(73) Assignee: M&R Printing Equipment, Inc., Glen Ellyn, IL (US)

( * ) Notice: Subject to any disclaimer, the term of this patent is extended or adjusted under 35 U.S.C. 154(b) by 0 days.

(21) Appl. No.: 09/395,120

(22) Filed: Sep. 14, 1999

Related U.S. Application Data

(63) Continuation-in-part of application No. 09/322,568, filed on May 28, 1999.

(51) Int. Cl.[7] ..... B41F 15/26

(52) U.S. Cl. ..... 101/474; 101/115; 101/126

(58) Field of Search ..... 101/474, 115, 101/126, 127.1, 128, 128.1, 35, 41, 114

(56) References Cited

U.S. PATENT DOCUMENTS

| | | | | |
|---|---|---|---|---|
| 3,958,508 | | 5/1976 | Sakurai | 101/407 |
| 4,242,956 | | 1/1981 | Bubley et al. | 101/123 |
| 4,819,559 | * | 4/1989 | Szarka | 101/126 |
| 4,846,058 | * | 7/1989 | Farris | 101/126 |
| 4,930,413 | | 6/1990 | Jaffa | 101/126 |
| 4,981,074 | | 1/1991 | Machita et al. | 101/126 |
| 5,014,614 | | 5/1991 | Thieme | 101/35 |
| 5,107,758 | * | 4/1992 | Withers | 101/126 |
| 5,162,926 | | 11/1992 | Yeadon et al. | 358/492 |
| 5,247,885 | | 9/1993 | Iaccino et al. | 101/474 |
| 5,313,882 | | 5/1994 | Karlyn et al. | 101/126 |
| 5,390,601 | | 2/1995 | Fricke et al. | 101/409 |
| 5,427,024 | | 6/1995 | Firth | 101/126 |
| 5,544,581 | | 8/1996 | Haji | 101/126 |
| 5,575,206 | * | 11/1996 | Szyszko | 101/126 |
| 5,699,742 | | 12/1997 | Ahrens et al. | 101/486 |
| 5,901,646 | * | 5/1999 | Walker et al. | 101/126 |
| 5,953,987 | * | 9/1999 | Oleson | 101/126 |
| 5,970,867 | * | 10/1999 | Barozzi | 101/126 |

* cited by examiner

*Primary Examiner*—Daniel J. Colilla
(74) *Attorney, Agent, or Firm*—Wallenstein & Wagner, Ltd.

(57) ABSTRACT

A new platen for use with a printing machine, and preferably for allowing automatic unloading of a printed article from a support surface of the platen is disclosed. The disclosed platen includes a structure for attachment to the printing machine, a support surface, and a gripping area disposed about the support surface to allow an automatic unloader to grip and remove an article from the support surface. The support surface is preferably rectangular having gripping areas proximate to each corner of the surface. The gripping areas are preferably notches within the support surface itself, but may also be in the form of a ledge with notches disposed along a portion of an edge and attached to the support surface.

31 Claims, 6 Drawing Sheets

10
12
14
16
17
19
20
22
24
30
40
50
52
13
15

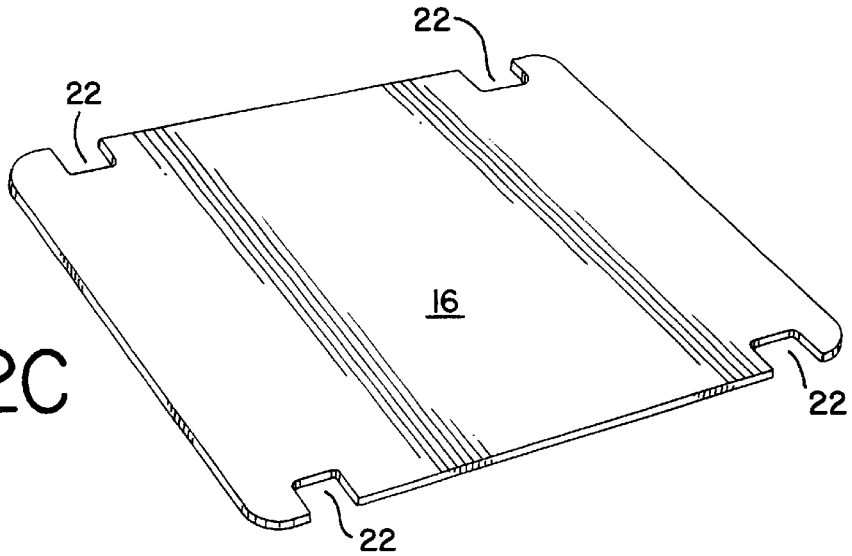
FIG. 2C
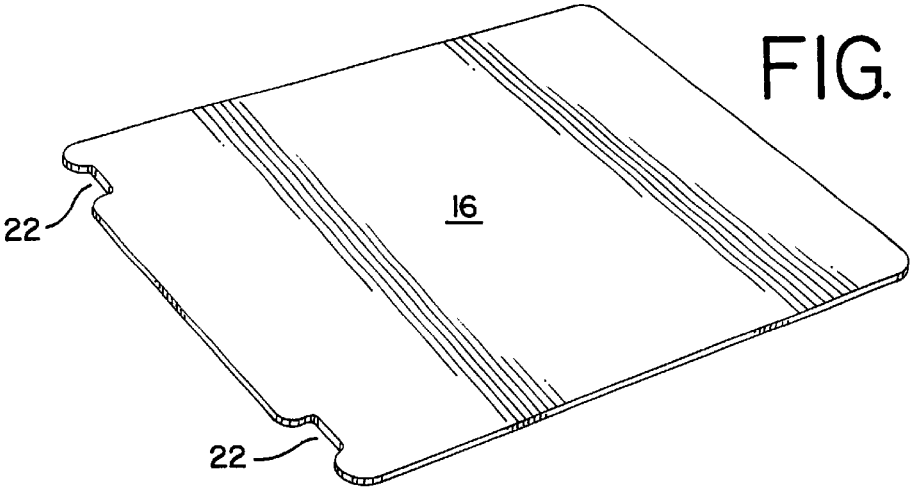
FIG. 2D
FIG. 2E
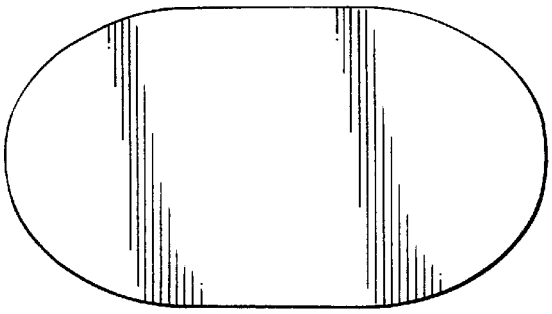
FIG. 2F
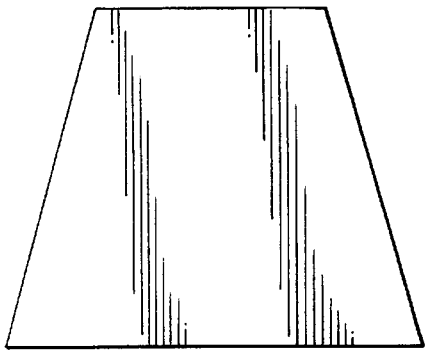

PLATEN FOR A PRINTING MACHINE

This is a continuation-in-part of U.S. Ser No. 09/322,568, filed May 28, 1999, and entitled "Extendable Gripping Means For Unloading An Article From A Screen Printing Machine."

TECHNICAL FIELD OF THE INVENTION

The present invention relates to the field of screen printing. Particularly, the present invention relates to platens for an automatic printing machine.

BACKGROUND OF THE INVENTION

Printed indicia for applying to items of clothing, such as T-shirts, sweatshirts, golf shirts, shorts, hats, and the like, as well as other cloth and paper goods, such as banners, posters, bags, flags, and the like, have become very popular over the last 20 years. Boutiques specializing in printing fanciful and textual indicia such as slogans, college names, sports team names and logos, licensed characters, and the like, on these various media, are commonly seen in stores across the country. The indicia available at these stores can be pre-printed on a substrate and applied with a heated press by operators at such boutiques to any of the aforementioned items purchased by a consumer, or they can be screen printed directly onto the items for later purchase.

In the screen printing process, a stencil screen is typically blocked (called "masked" in the industry) to embody the desired indicia and is then placed over the item to be printed. Ink of one color is then added to the screen surface and flooded onto the indicia by a flood bar of conventional design. The ink may be of any type well-known in the industry for screen printing. After the ink is flooded onto the screen, the ink is squeegeed through the screen interstices onto the item, leaving ink of the desired color where the interstices in the screen are unblocked. The squeegee can be of any type known in the art.

After the item is printed on, it is moved to a station where one or more operators transfer the article to a drying rack, conveyor surface leading to a dryer, or the like. This requires quick and deft handling by the operator because the cycling of the printing machine may print a shirt every four to six seconds. Further, as the articles are typically adhered to the platen with an adhesive, the article must be lifted at an angle to break the adhesive seal without smudging the print on the article.

The quick, repetitive movement may take its toll on the operator after some amount of time. Therefore, it is advantageous to automate such a repeatable process. A few reasons for automatically unloading an article from a printing surface of a printing machine are: (1) to allow printing machine operators to concentrate on other areas of printing; (2) to diminish the likelihood of ruining printed articles; (3) to increase the repeatability of the exact placement of unloaded articles; and, (4) to reduce injury risk to printing machine operators.

In automating any task, it is often necessary to make alterations to existing equipment to accommodate new techniques or processes, especially where human senses, such as sight and touch, are being replaced by inanimate machinery. The present invention is no exception.

SUMMARY OF THE INVENTION

In accordance with the present invention, a new platen is provided for use with an apparatus for unloading or removing an article from a printing machine, and preferably transferring the same to a suitable drying surface. One embodiment of the disclosed platen includes a support surface, means for attaching the support surface to the printing machine, and at least one recessed area for allowing extendable gripping means of the automated unloader to engage the supported article.

Additionally, it is an aspect of the present invention to provide at least one platen attached to the printing machine in a manner allowing the extendable gripping means to vertically extend from the support frame to an area of the platen(s). To permit gripping of the articles, the platen are notched at the area corresponding to the extendable gripping means.

Alternatively, the platen may include a ledge at the area corresponding to the extendable gripping means. This ledge also allows the supported article to be gripped by the gripping means. The extendable gripping means may take a variety of forms including as a pair or numerous pairs of automatic jaws. Each automatic jaw corresponds to a notch in a ledge (or recessed area of a ledge) or notch in the support surface of the platen.

It is further an aspect of the present invention to provide at least one gripping area on the platen. The gripping area allows all manner of automated devices to engage the supported article and remove the article from the support surface of the platen. Such gripping areas may include recessed edges, surface contours, ledges, extensions, peripheral devices, and the like, as part of the platen.

It is an aspect of the present invention to prevent, or at least minimize, the ruining of the printed indicia by maintaining the article in a taut manner as it is unloaded from the printing machine. Accordingly, the present invention includes a telescoping rod for each vertically extending pair of automatic jaws. Preferably, the jaws, via the telescoping rods, will move diagonally upward from two ends of the article to slightly stretch the article upon lifting.

These and other aspects of the present invention set forth in the appended claims may be realized in accordance with the following disclosure with particular reference to the accompanying drawings.

DESCRIPTION OF THE DRAWINGS

FIG. 2C is a perspective view of an alternative embodiment of the platen of the present invention having notched areas on the sides of the platen;

FIG. 2D is a perspective view of an alternative embodiment of the platen of the present invention having only a single pair of notched areas on one end of the platen;

FIGS 2E and 2F are top views of alternative embodiments of the platen support surface;

DETAILED DESCRIPTION OF PREFERRED EMBODIMENT

While the invention is susceptible of embodiment in many different forms, this disclosure describes, in detail, preferred embodiments of the invention with the understanding that the present disclosure is to be considered as an exemplification of the principles of the invention and is not intended to limit the broad aspects of the invention to the embodiments illustrated.

Referring generally to the appended FIGS. 1–11, the process of a screen printing operation using the present invention can be more readily understood. The disclosed automatic unloader is generally referenced by the number "10" in the following disclosure and drawings. Other components are similarly and consistently numbered throughout. While the present invention is particularly designed for automatic rotary and oval printing machines, such as, for example, the CHALLENGER™ and the GAUNTLET™, and their progeny, manufactured by M&R Printing Equipment, Inc. of Glen Ellyn, Ill., other such automatic printing systems may be capable of adaptation for implementation of the system as well.

Figures 1, 2A, 2B:
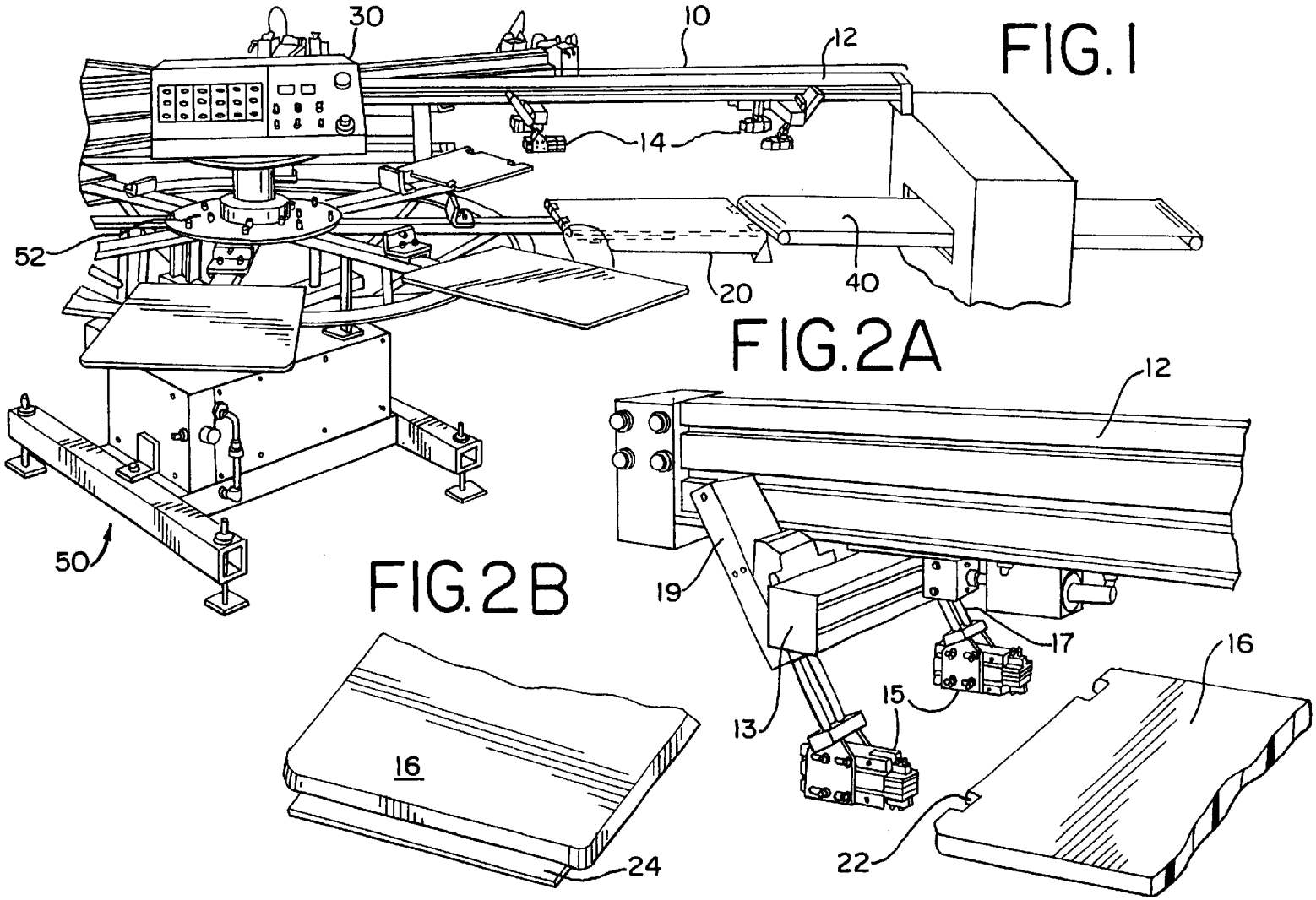
FIG. 1 is a partial perspective view of an automatic printing machine illustrating the relative positioning of an embodiment of the present invention.
FIG. 2A is a close-up perspective view of a pair of automatic jaws extending toward a notched platen.
FIG. 2B is a perspective view of a partial platen equipped with an alternative ledge on one end.

As shown in FIG. 1, the present automatic unloader 10 is generally attached to a printing machine 50 at an "open" station. An "open" station is defined as a station of the printing machine 50 which is not used for printing, drying, or any other purpose uncooperative with the unloading of articles. It is not necessary to create the "open" station on existing printing machines, since such station are typically provided for manual unloading operations replaced by the present automatic unloader 10. The "open" station is preferably just after the last printing station of the printing machine 50. In this way, the usual operation of the printing machine 50 —rotating the platen carousel 52 in a clockwise or counter-clockwise fashion from a first to a last printing station—need not be changed. The present invention can be readily retrofit to such existing printing machines, as will be understood from the following disclosure.

Figure 8:
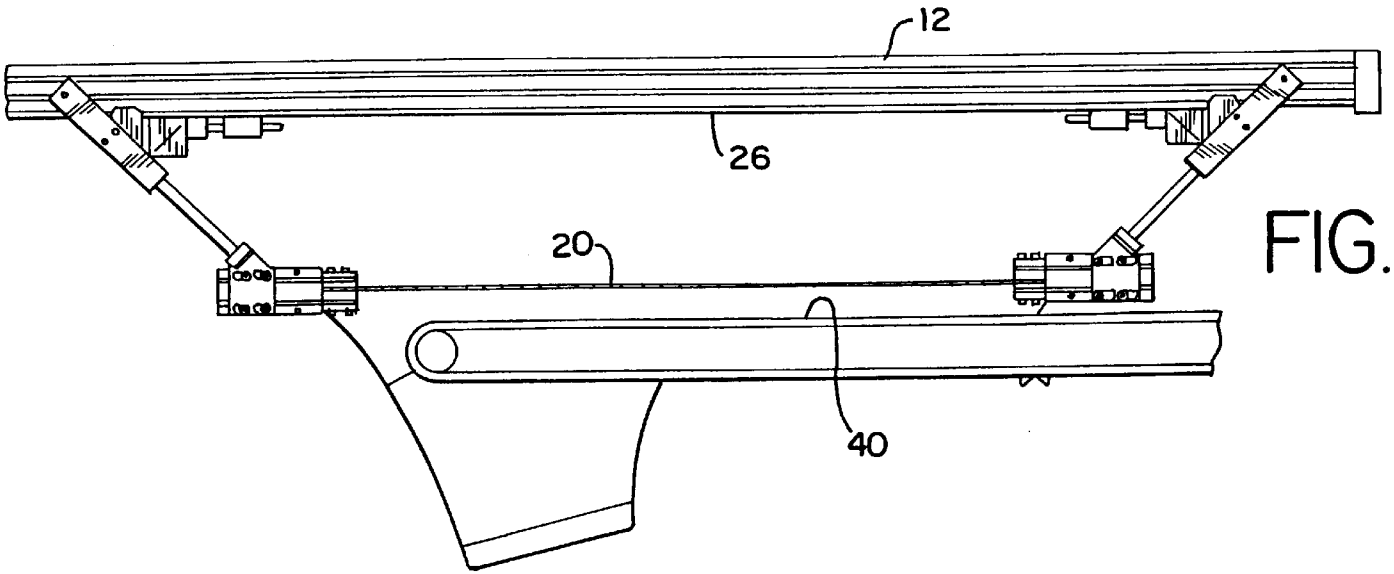

The automatic unloader 10 is used to unload an article 20 from a screen printing machine 50 and place the articles 20 onto a second surface 40, such as a dryer rack, conveyor surface, or the like (FIGS. 1 and 8). The second surface 40 is preferably positioned to be adjacent the unloader 10, as illustrated in FIG. 1. The unloader 10 includes a support frame 12, an extendable gripping means 14 attached to the support frame 12 for engaging the printed article 20, and a conventional controller 30 for controlling the operation of the extendable gripping means 14.

The support frame 12 is preferably a radial arm of the printing machine 50, as shown in FIG. 1, made from an extruded aluminum, aluminum alloy, or any other strong, lightweight material. The support frame 12 is preferably channeled and extends a substantial distance from attachment to the printing machine 50. This extension allows an unloaded article to be placed directly onto the second surface 40 where the article 20 can be dried or cured before packaging. Additionally, the support frame 12 may include at least one spacer bar 13, preferably two spacer bars 13*a* and 13*b*, for providing adequate spacing between paired gripping means 14.

Figure 3:
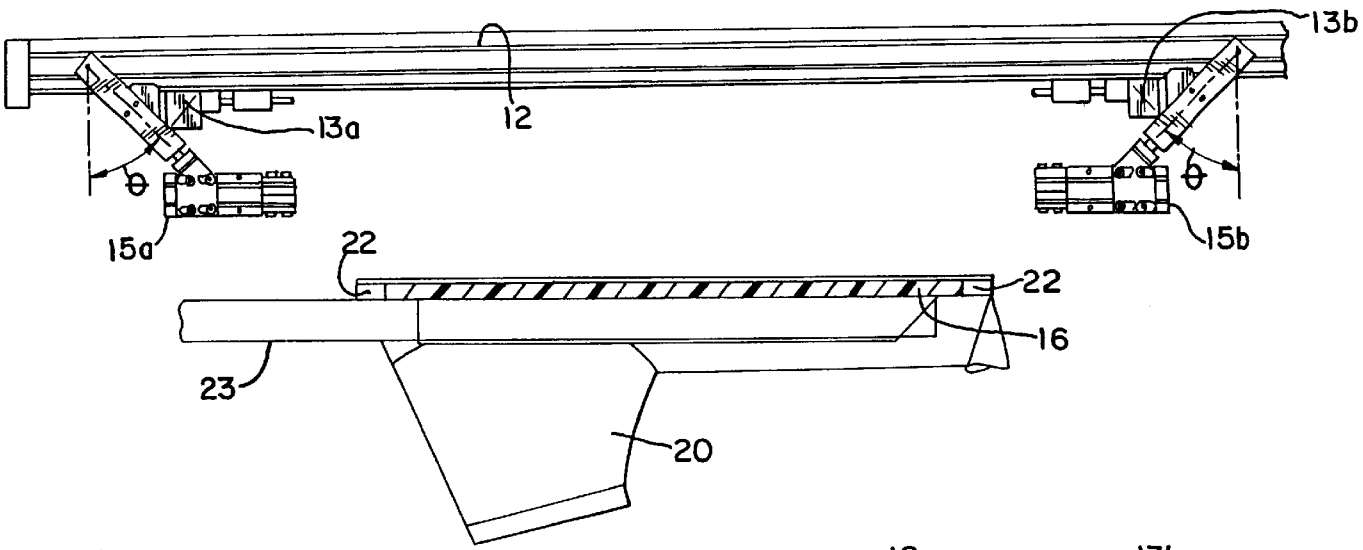
FIGS. 3 through 8 are side elevation views of an embodiment of the present invention illustrating the unloading and delivery of an article to a second surface.
Figure 4:
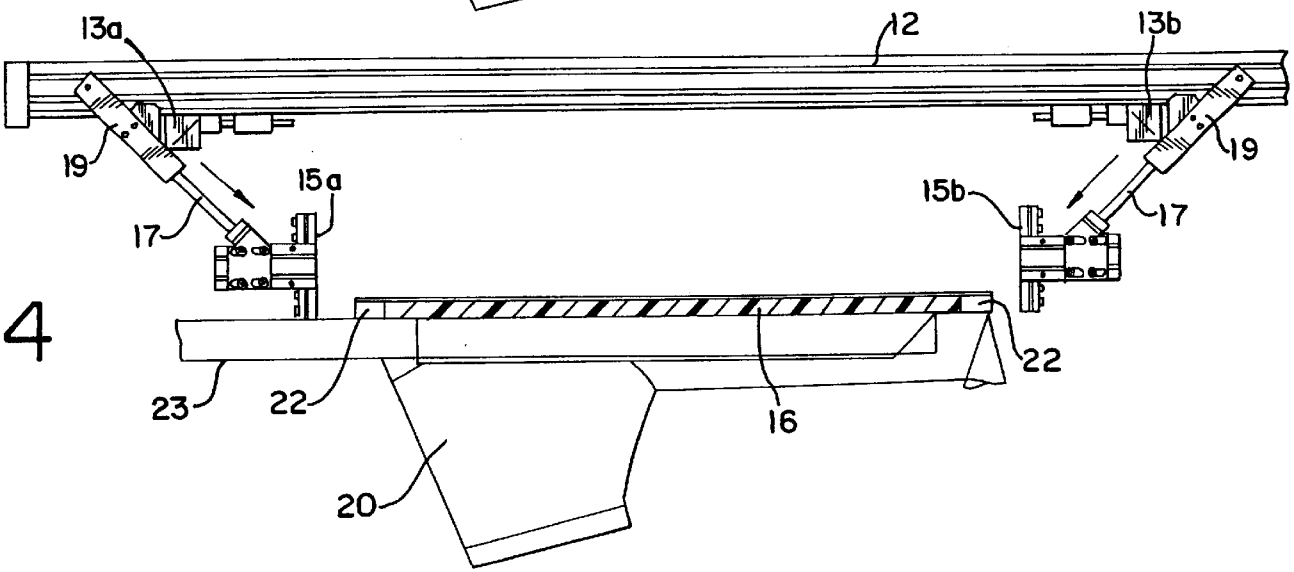

The extendable gripping means 14 is preferably at least one pair of jaws 15, more preferably two pair of jaws 15, but most preferably four pair of jaws 15. In one preferred embodiment, the jaws 15 are operated using conventional pneumatic, hydraulic, electronic, or mechanical (e.g., a conventional stepper motor and conventional servo) controls to alternate between a closed position (FIG. 3) and an open position (FIG. 4). The gripping pressure of the jaws 15 should be sufficient to grip and hold a relatively thin article (a single layer of material, for instance) under a given amount of lateral strain.

Where multiple pairs of jaws 15 are used it is advantageous to group them together by two's, as shown in FIG. 2A. For instance, the use of four pair of jaws is preferably configured having two pair of jaws 15*a* on a front spacer bar 13*a* and two pair of jaws 15*b* on a rear spacer bar 13*b*. The two spacer bars 13*a* and 13*b* are arranged a distance apart and attached to a drive mechanism (not shown) within the channel of support frame 12. The drive mechanism moves the spacer bars 13*a* and 13*b*, and thus the jaws 15, horizontally back and forth between a position above the platen 16 and a position above the second surface 40. The channel of the support frame 12 serves as a guide track 26 to this movement. The drive mechanism may be a continuous belt and pulley, a chain and sprocket, or any other conventional track capable of such reciprocating motion. Any conventional power plant, such as a motor, may be used to actuate the drive mechanism.

In order to reach the platen 16, each pair of jaws 15 is preferably capable of being vertically extended, via a telescoping rod 17, from a body portion 19 toward the platen 16, as shown in FIG. 4. The telescoping rod 17 may allow extension up to about two feet (24 inches) or more. Longer extensions, of course, may require additional support to insure the structural integrity of the mechanism.

The phrase "vertically extended" is meant to include jaws extending in a direction having a vertical component. In is not intended to exclude jaws, such as those of the present embodiment, which also extend in a direction having a horizontal component, as well. The horizontal component of extension is a result of the angle of attachment of the jaws 15 to the spacer bars 13*a* and 13*b*. This angle of attachment ($\theta$) may be within the range of from about 10° to about 80° relative to a line perpendicular to the support frame 12, as shown in FIG. 2A. Having the jaws 15 in a raised set position, as shown in FIG. 3, allows the jaws 15 to be maintained out of the way of the rotating carousel 52 until needed.

The angle of attachment ($\theta$), allowing lifting of the article 20 along the same angle, serves a two-fold function. First, in placing the articles 20 onto the printing machine platen 16, an adhesive is typically applied to keep the article from moving about as the carousel 52 turns. After printing, the article 20 can be quite attached to the platen 16 as a further result of the pressure applied during printing. In order to remove the article 20 quickly it is preferably lifted on an angle to break the contact between the article 20 and the platen 16.

Second, by permitting the slight horizontal travel of the jaws 15 upon retraction, the jaws 15 stretch the article 20 to maintain a taut printed indicia. As a means for creating and maintaining this taut printed indicia, the present invention uses the four jaws 15 and the angle of attachment ($\theta$). These features help to prevent wrinkling, overlapping, creasing, or otherwise ruining the printed indicia of the article 20.

The platen 16 of the present embodiment, machined from metal stock, preferably includes at least one gripping area on the support surface 17. Preferably, the gripping area is comprised of four (4) notched areas or notches 22—FIG. 2A shows two notched areas 22 on one end of the platen 16—corresponding to the placement of the four jaws 15 and overlapped by the printed article 20. That is, as the jaws 15 are extended toward the platen 16, they encounter the article 20 at the four notched areas 22. Alternatively, only one end of the platen 16 may be notched, as shown in FIG. 2D, and other devices such as ledges (FIG. 2B), edge extensions (FIGS. 9–11), surface contours, and the like, may be used in place of notched platens. The idea is to provide the platen 16 with a means which allows the article to be engaged and lifted from its supported position on the platen 16.

While the present embodiment of FIGS. 2A–2B show the notched areas 22 along a front edge of the platen 16, it is intended that these notches 22 (or other devices) may be alternately placed about other edges of the platen 16 (e.g., the rear edge, the left side edge, and the right side edge), as shown in FIGS. 2C–2D, with similar adjustment made to the extending jaws 15, and remain within the scope of the appended claims. The drawing figures also show a substantially rectangular platen 16 as the preferred shape. However, platens may be designed in any number of various geometric shapes, such as substantially circular, oval, trapezoidal, or the like, or even fanciful shapes combining curved and straight edges to effect a desired shape.

The notches 22 may vary widely in size—depending upon factors including the size of the article being printed on, the size of the gripping jaws, and the size of the platen. Preferably, the area covered by the notches (i.e., the area notched from the support surface 17 of the platen 16) may be as small as about 0.25 inches in length or width and as large as about 5 inches in length or width. The preferred total area of the notch may vary within the range of from about 0.0625 $in^2$ to about 25 $in^2$. More preferably, however, the area of the notch 22 varies within the range of from about 1 $in^2$ to about 9 $in^2$.

As shown in FIGS. 3–7, a bracket structure 23 attaches the support surface or platen 16 to the printing machine 50.

Figure 5:
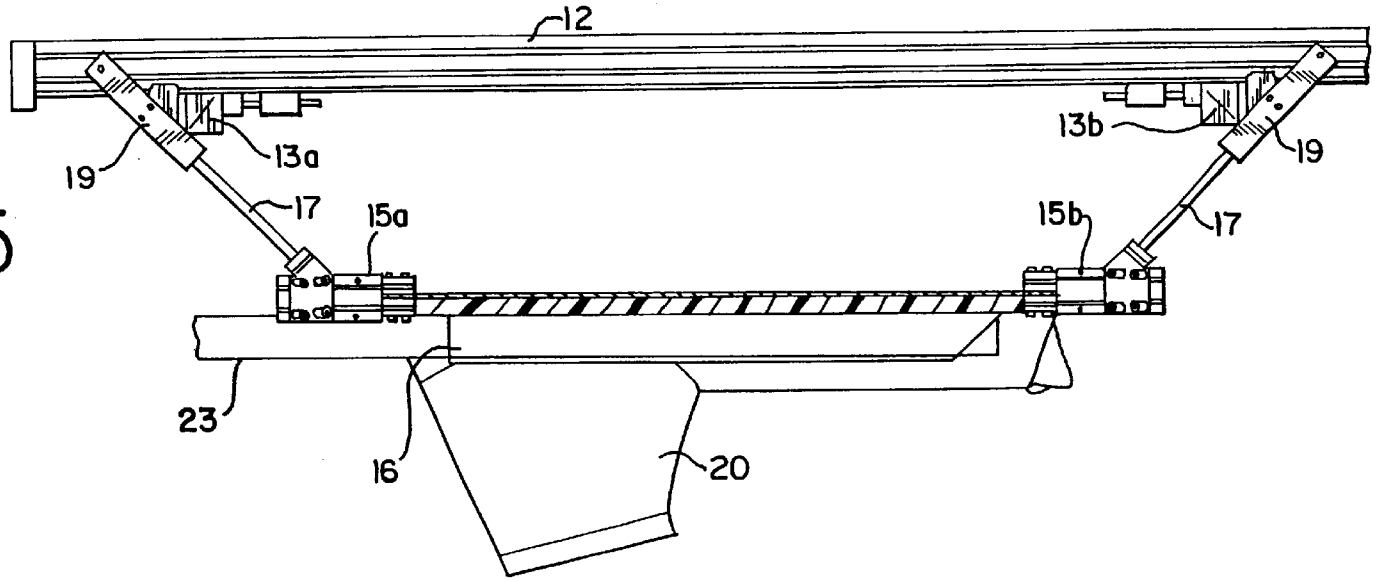
Figure 6:
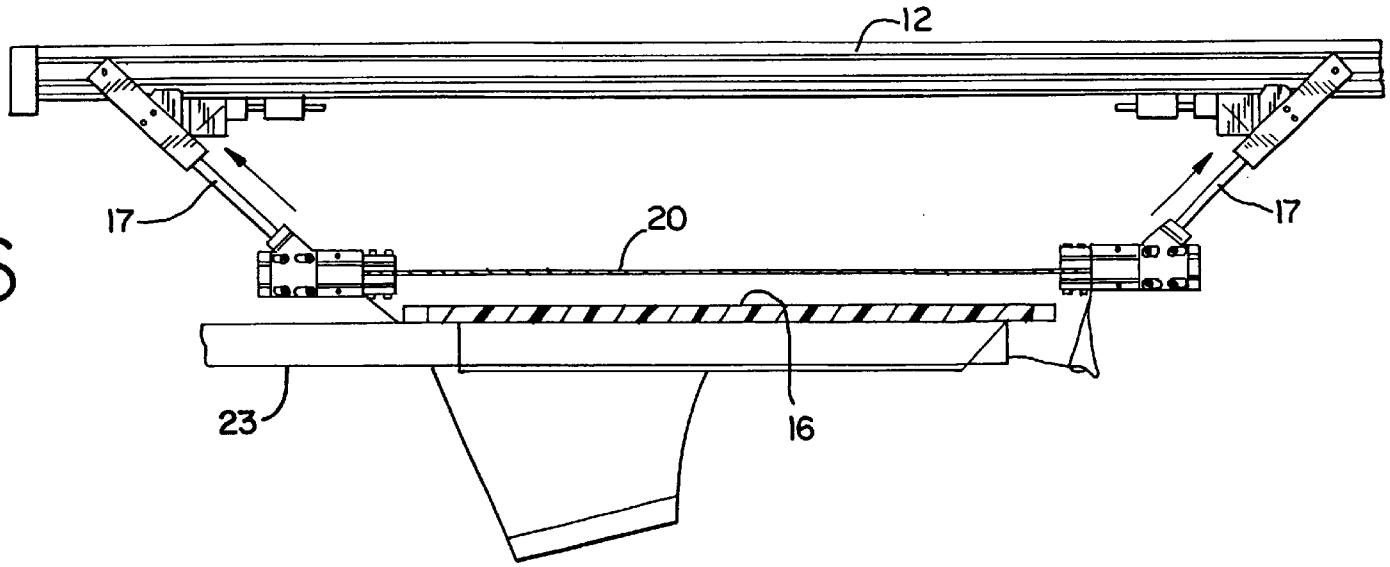

Upon closing the jaws 15, as shown in FIG. 5, the jaws 15 grip or engage the printed article 20 at the notched areas 22. As the jaws 15 are retracted, as shown in FIG. 6, the two pairs of jaws 15*a* pull the article 20 slightly in one direction, while the two pair of jaws 15*b* pull the article 20 slightly in a substantially opposite direction. At this point the printed indicium is held taut from four points of the article 20 preventing accidental transfer of ink on the article 20.

Figure 9:
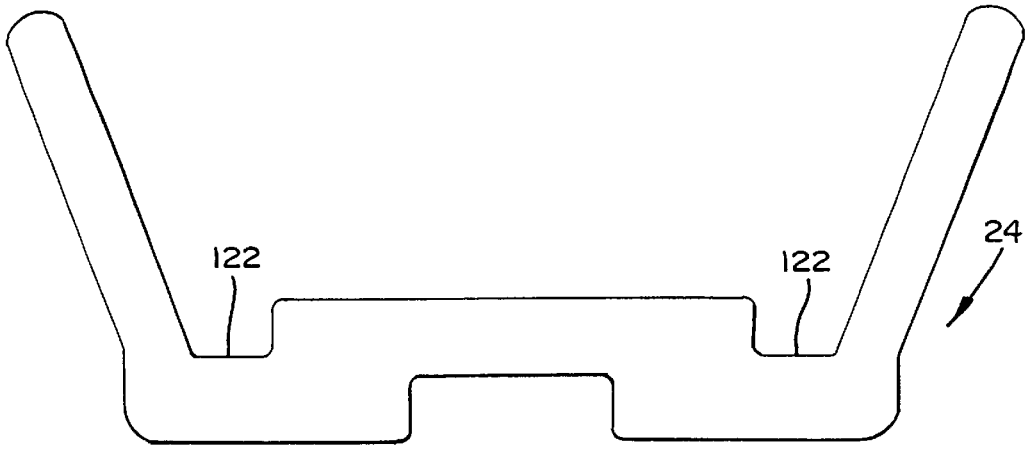
FIG. 9 is a top view of one embodiment of a platen attachment (or ledge) of the present invention.
Figure 10:
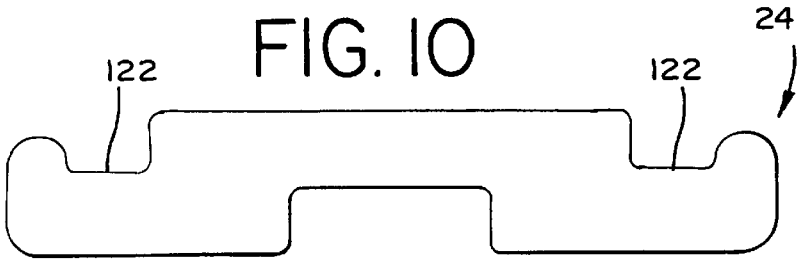
FIG. 10 is a top view of an alternative embodiment of a platen attachment (or ledge) of the present invention.

In an alternative design, existing platen may be fitted with a ledge (or platen attachment) 24 at the areas corresponding to the jaws 15, as shown in FIGS. 9 and 10. The ledge 24 would preferably be a short, relatively thin, substantially planar surface attached to the underside of the platen 116. The ledge 24 would serve to extend a sufficient portion of the article 20 to be gripped by the jaws 15, while still providing the notched areas 122 for gripping the article. Each of the ledge 24 need not extend the full length or width of the platen 16, but just a sufficient amount to extend the article 20, as needed.

Figure 11:
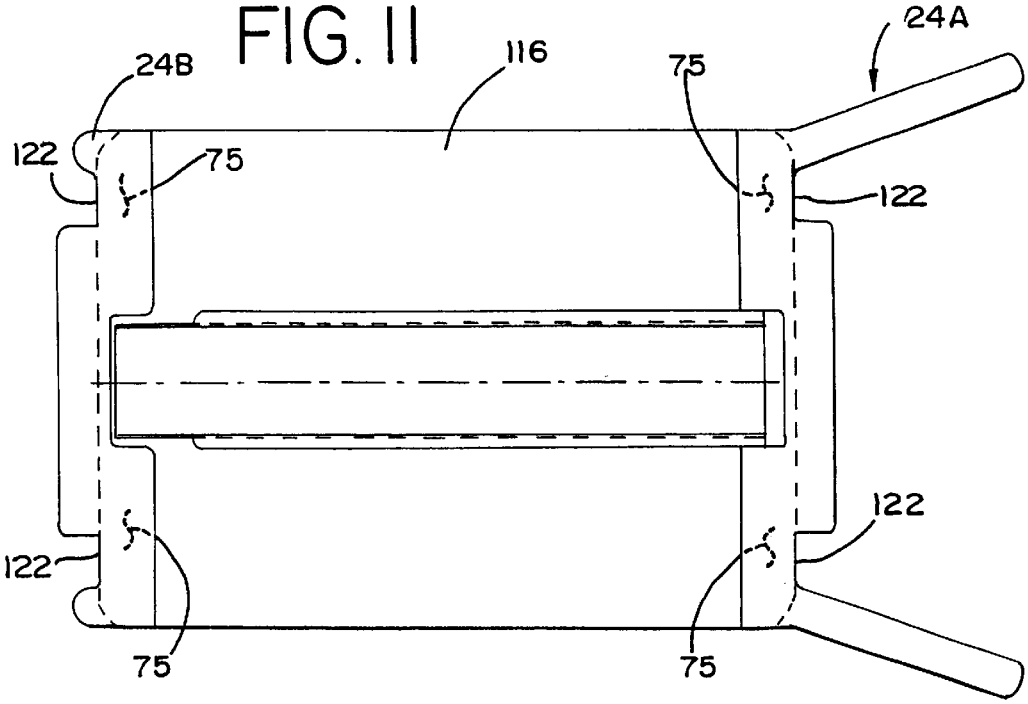
FIG. 11 is a top view of the platen attachment (or ledge) embodiments shown in FIGS. 9 and 10 as they can be attached to a platen.

Referring to FIG. 11, two ledges 24A and 24B may be provided which attach to opposite ends of the platen 116. Though attachment to only two sides are shown, it is contemplated that ledges may be attached to left and right sides of the platen as well, as illustrated by the notches in FIG. 2C. Adaptation to this feature would be understood by those skilled in the relevant art. The means for attaching the ledges 24A and 24B to the platen 116 may be any conventional permanent or detachable means, 75 including—but not limited to—screws, bolts, adhesive, epoxy, welds, clamps, clips, hook-and-loop, slots, sockets, and similar mechanisms or compounds.

The jaws 15, telescoping rods 17, and spacer bars 13*a* and 13*b* are elements known to those skilled in the respective mechanical arts, and may include an infinite variety of designs which achieve the desired results. Movement and control of these devices is preferably administered by a programmable controller 30, such as presently used to operate the printing machine 50. In their simplest form, each device has two alternate positions: the jaws 15 may be open or closed; the telescoping rods 17 may be extended or retracted; and, the spacer bars 13*a* and 13*b* may be positioned over the platen 16 or over the second surface 40.

In operation, the varied combinations of the alternate positions in the proper order, achieves the desired goal, as illustrated in TABLE 1 below. Naturally, intermediate steps may be added to the present operations to accomplish other tasks, such as inspection of printed articles, alternate delivery points of printed articles, and the like.

TABLE 1

Operation Positions for Automatic Jaws, Telescoping Rods, and Spacer Bars

| Operation | Jaw Position | Telescoping Rod Position | Spacer Bar Position |
|---|---|---|---|
| No article-set position | open | retracted | over platen |
| approach platen | open | extended | over platen |
| engage article | closed | retracted | over platen |
| lift article | closed | retracted | over platen |
| move article | closed | retracted | over 2nd surface |
| approach surface | closed | extended | over 2nd surface |
| deliver article | open | extended | over 2nd surface |
| prepare for return | open | retracted | over 2nd surface |
| return-set position | open | retracted | over platen |

The method of one embodiment for automatically unloading an article from a screen printing machine includes first positioning the article 20 for printing on the notched platen 16. Then printing on at least a portion of the article 20 to produce a printed article. The printed portion may cover a very small area of the article, or it may cover a substantial portion of the article. After printing, the article 20 may be automatically engaged with a gripping means at an area corresponding to each notch 22 on the platen 16, and then lifted from the platen 16 with the gripping means at each engaged area simultaneously.

To prevent ruining the printed article, it is necessary to maintain the tautness in the printed portion of the article as it is lifted from the platen 16. In the preferred embodiment, the tautness is maintained by moving the gripping means in a direction having a horizontal component. Preferably, there are two separate gripping means, and the gripping means corresponding to the notch 22 on the first end of the platen 16 are moved in a direction having a horizontal component substantially opposite the horizontal component of the direction moved by the gripping means corresponding to the notch 22 on the second end of the platen 16. That is, the article is slightly stretched between the two gripping means, as shown in FIG. 6.

Figure 7:
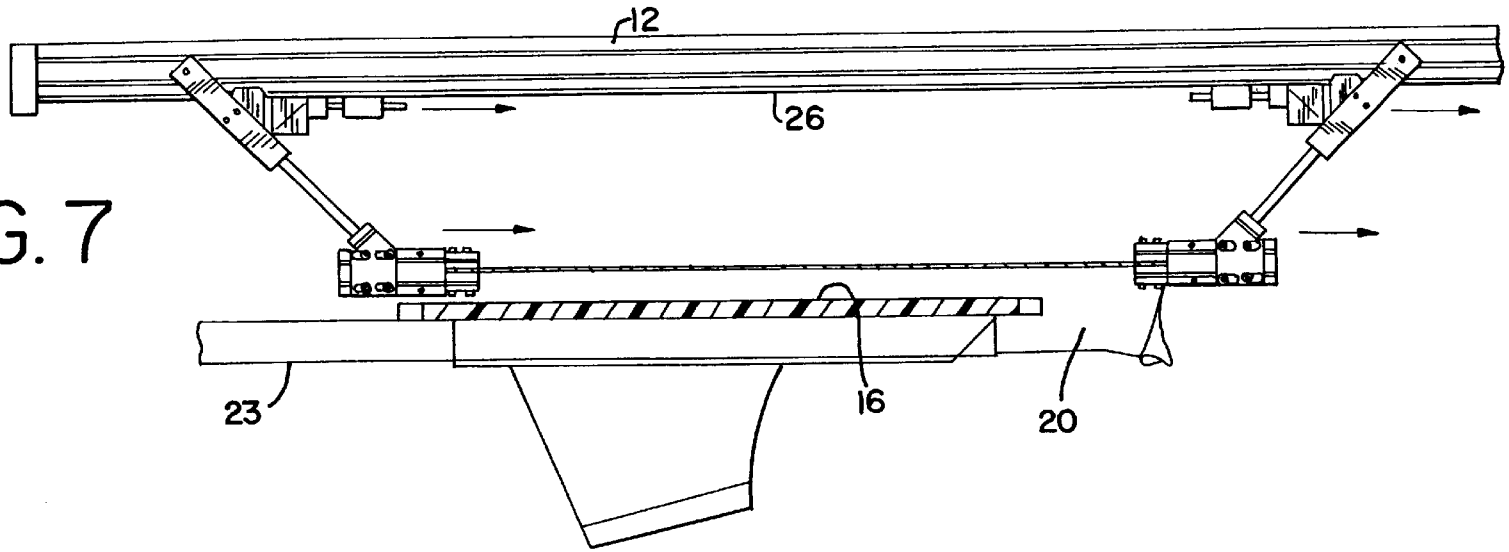

The article 20 can then be moved with this maintained tautness to a delivery position, as illustrated by FIG. 7. The method is furthered by automatically placing the article onto a second surface, as illustrated by FIG. 8. The second surface may be a drying surface or conveyor for taking the article 20 through a curing device or the like.

Because the automatic jaws 15 are spaced in a fixed relation, and the guide track 26 insures an exact path of travel with each article 20, the placement of the article on the second surface 40 is essentially identical each time. This allows further automation to be employed after the articles are dried to fold, package, tag, and box the printed articles for distribution.

While specific embodiments have been illustrated and described, numerous modifications are possible without departing from the spirit of the invention, and the scope of protection is only limited by the scope of the accompanying claims.

We claim:

1. A platen used with a printing machine for supporting an article during a printing process comprising:

a support surface;

means for attaching the support surface to the printing machine; and means integral with the support surface for permitting an automatic unloader to grip and remove the supported article without gripping the support surface.

2. The platen of claim 1, wherein the means integral with the support surface for permitting an unloader to grip and remove the supported article comprises at least one recessed area.

3. The platen of claim 2, wherein each recessed area is a notch within a side of the support surface and is defined by an outer edge of the surface.

4. The platen of claim 3, wherein each notch covers an area of the support surface within a range of from about 0.0625 $in^2$ to about 25 $in^2$.

5. The platen of claim 4, wherein each notch covers an area of the support surface within a range of from about 1 $in^2$ to about 9 $in^2$.

6. The platen of claim 3, wherein the notches are paired in opposing edges of the support surface.

7. The platen of claim 2, wherein the at least one recessed area on the support surface is provided by at least one detachable ledge.

8. The platen of claim 7, wherein the platen has two detachable ledges, each attached to an opposite end of the support surface.

9. The platen of claim 2, wherein the at least one recessed area comprises a ledge along at least a portion of an edge of the support surface.

10. The platen of claim 9, wherein the ledges are paired in opposing edges of the support surface.

11. A platen for use with a printing machine and for supporting an article during a printing process comprising:

a support surface having a first pair of opposing side edges, and a second pair of opposing side edges;

means for attaching the support surface to the printing machine; and means integral with the support surface for permitting an automatic unloader to grip and remove the supported article without gripping the support surface.

12. The platen of claim 11, wherein the means integral with the support surface for permitting an automatic unloader to grip and remove the supported article comprises at least one gripping area disposed about the support surface.

13. The platen of claim 12, wherein a gripping area is disposed proximate each corner of the rectangular support surface.

14. The platen of claim 12, wherein each gripping area is a notch within a side of the support surface and is defined by an outer edge of the surface.

15. The platen of claim 14, wherein each notch covers an area of the support surface within a range of from about 0.0625 $in^2$ to about 25 $in^2$.

16. The platen of claim 15, wherein each notch covers an area of the support surface within a range of from about 1 $in^2$ to about 9 $in^2$.

17. The platen of claim 14, wherein there are at least two pair of notches in the first opposing side edges of the support surface.

18. The platen of claim 14, wherein there are at least two pair of notches in the second opposing side edges of the support surface.

19. The platen of claim 12, wherein the at least one gripping area comprises at least one ledge along at least a portion of an edge of the support surface.

20. The platen of claim 19, wherein the recessed area comprises at least two ledges positioned in the first opposing side edges of the support surface.

21. The platen of claim 19, wherein the recessed area comprises at least two ledges positioned in the second opposing side edges of the support surface.

22. The platen of claim 11, wherein the support surface is substantially oval-shaped.

23. The platen of claim 11, wherein the support surface is substantially trapezoidal.

24. A platen system for allowing an article to be removed from a platen by an automatic unloader, the system comprising:

at least one substantially planar surface having means integral with the surface for permitting an automatic unloader to grip and remove the supported article without gripping the surface;

means for attaching the at least one substantially planar surface to the platen.

25. The platen system of claim 24, having two substantially planar surfaces.

26. The platen system of claim 25, wherein the two planar surfaces attach to opposite sides of the platen.

27. The platen system of claim 25, wherein each planar surface has two recessed areas therein.

28. The platen system of claim 24, wherein the at least one planar surface attaches to an underside of the platen.

29. A platen for use with a printing machine and for supporting an article during a printing process comprising:

a substantially rectangular support surface having a first pair of opposing side edges, and a second pair of opposing side edges;

a bracket structure attaching the support surface to the printing machine; and means integral with the support surface for permitting an automatic unloader to grip and remove the supported article without gripping the support surface including a plurality of notches disposed along at least one side edge of the support surface proximate to a corner of the surface, wherein each notch covers an area of the support surface within a range of from about 1 $in^2$ to about 9 $in^2$.

30. The platen of claim 29, wherein the means integral with the support surface comprises at least two pair of notches in the first opposing side edges of the support surface.

31. The platen of claim 29, wherein there are at least two pair of notches in the second opposing side edges of the support surface.

* * * * *